United States Patent [19]

Poll et al.

[11] Patent Number: 4,519,321

[45] Date of Patent: May 28, 1985

[54] BURNER FOR THE PARTIAL COMBUSTION OF SOLID FUEL

[75] Inventors: Ian Poll, The Hague; Jacobus A. J. Smit, Amsterdam, both of Netherlands

[73] Assignee: Shell Oil Company, Houston, Tex.

[21] Appl. No.: 586,481

[22] Filed: Mar. 5, 1984

[30] Foreign Application Priority Data

Mar. 18, 1983 [GB] United Kingdom ..... 8307520

[51] Int. Cl.[3] ..... F23D 1/00

[52] U.S. Cl. ..... 110/263; 110/347; 239/295; 239/299; 239/433

[58] Field of Search ..... 110/263, 264, 265, 347; 431/8, 160; 239/295, 299, 426, 433, 434

[56] References Cited

U.S. PATENT DOCUMENTS 2,614,000 10/1952 Reinhold ..... 239/295

3,033,133 5/1962 Kelley et al. ..... 239/433 X 3,595,480 7/1971 Kunioka et al. ..... 239/433

FOREIGN PATENT DOCUMENTS 2079439A 1/1982 United Kingdom .

*Primary Examiner*—Edward G. Favors

[57] ABSTRACT

A burner for the partial combustion of a finely divided solid fuel, comprising a central channel with a central outlet for free-oxygen containing gas, laterally disposed conduit means for finely divided solid fuel, the conduit means having outlet means whose major axis is positioned to intersect the axis of the central outlet and being asymmetrically arranged with respect to said central outlet. The invention further relates to a process for the partial combustion of a finely divided solid fuel, wherein one or more burners of the above type are applied.

12 Claims, 6 Drawing Figures

BURNER FOR THE PARTIAL COMBUSTION OF SOLID FUEL

BACKGROUND OF THE INVENTION

The present invention relates to a burner for use in a partial combustion process for producing synthesis gas from a finely divided solid fuel, such as pulverized coal. The invention further relates to a process for the partial combustion of a finely divided solid fuel in which process such a burner is used.

The generation of synthesis gas is achieved by the partial combustion, also called gasification, of a hydrocarbonaceous fuel with free-oxygen at relatively high temperatures. It is well known to carry out the gasification in a reactor into which solid pulverized fuel and free-oxygen containing gas are introduced either separately, or premixed at relatively high velocities. In the reactor a combustion process is maintained in which the fuel reacts with the free-oxygen at temperatures above 1000° C. The solid fuel is normally passed together with a carrier gas to the reactor via a burner, while free-oxygen containing gas, such as pure oxygen or oxygen-rich air, is introduced into the reactor via the same burner either separately or premixed with the solid fuel. Since solid fuel, even when it is finely divided, is normally poorly reactive, great care must be taken that the reactants, the fuel and the free-oxygen, are effectively mixed with one another prior to or during the combustion process. Inadequate mixing of the reactants will result in the generation of a product gas with a varying constituency, which is caused by the fact that parts of the fuel receive insufficient oxygen for a proper gasification in the time available, while other parts of the fuel receive too much oxygen, so that in the latter case the fuel is completely converted into less valuable end products, viz. carbon dioxide and water vapor. Inadequate mixing of the reactants has another important disadvantage in that zones of overheating are generated in the reactor which zones might cause damage to the internal refractory lining of the reactor and/or the applied burner(s).

In order to attain a sufficient mixing of solid fuel with oxygen it has already been proposed to mix the fuel and oxygen in or upstream of the burner prior to introducing the fuel into the reactor. This implies, however, a disadvantage in that—especially at high pressure gasification—the design and operation of the burner are highly critical. The reason for this is that the time elapsing between the moment of mixing the fuel with oxygen and the moment the fuel/oxygen mixture enters into the reactor zone must be invariably shorter than the combustion induction time of the mixture. The combustion induction time shortens, however, at a rise in gasification pressure and as burner size increases. If the burner is operated at a low fuel load or, in other words, if the velocity of the fuel/oxygen mixture in the burner is low, combustion of the fuel/oxygen mixture may easily take place in the burner itself, which would result in overheating and the risk of severe damage to the burner.

The above problem of premature combustion of the fuel in the burner itself can be overcome by mixing the fuel and oxygen outside the burner in the reactor zone itself. In the latter case, special steps should, however, be taken to obtain a good mixing of fuel with oxygen, necessary for a proper gasification of the fuel.

Various designs have been made in the past in an attempt to provide a burner which produces during operation a substantially uniform mixture of solid fuel with oxygen in the reactor space. These burners are normally of the so-called axisymmetric type, i.e., which produce essentially axisymmetric flows of fuel and oxygen during operation, and which employ mainly the momentum of the oxygen flow to break up the flow of solid fuel. In these burners the solid fuel is normally transported through a centrally arranged channel while the oxygen is supplied at an angle to the issuing coal flow. Use of the momentum of the oxygen flow for breaking up the core of solid fuel is, however, limited by the maximum allowable oxygen velocity in the burner above which friction-induced ignition of the burner material might occur. A further limitation of the momentum of the oxygen flow is set by the maximum throughput of oxygen which is constrained by requirement of efficient gasification of a particular type of solid fuel at a given load factor. Axisymmetric injection of solid fuel and oxygen into a reactor can therefore lead to unburned solids resulting in a conversion loss and thus a reduction of the efficiency of partial combustion.

Apart from a loss in the rate of conversion insufficient break-up of the coal flow can further lead to blockage of the reactor-slagtap due to unburned or insufficiently burned solids and/or contamination of the product gas with fine particles of unconverted fuel. This particularly applies to reactor geometries where the slagtap and/or the product gas outlet are placed symmetrically with respect to the main flow axis or with respect to the burner axis.

An object of the present invention is to overcome the above problem of insufficient breaking up of the solid fuel flow resulting in conversion losses, blockage of the reactor outlet and/or contamination of the product gas.

SUMMARY OF THE INVENTION

According to the invention a burner for the partial combustion of a finely divided solid fuel is provided comprising a central channel with a central outlet for free-oxygen containing gas, laterally disposed conduit means for finely divided solid fuel, said conduit means having outlet means whose major axis is positioned to intersect the axis of the central outlet, said outlet means being asymmetrically arranged with respect to said central outlet.

DESCRIPTION OF THE INVENTION

Due to the asymmetrical position of the fuel outlet means with respect to the central oxygen outlet use is made of both the oxygen flow and the solid fuel flow momenta to effectively break-up and disperse the solids over the oxygen flow during operation of the burner. This means the oxygen and fuel velocities can be kept rather moderate so that the risk of friction induced overheating of the burner material can be substantially eliminated without, however, adversely affecting the rate of break-up of the solids flow.

During operation of the burner according to the invention a solid fuel/oxygen flow is obtained which is asymmetric with respect to the burner axis. This flow pattern largely prevents short circuiting of the reactor flow in reactors having a symmetrical arrangement of the burners, the slagtap and the product gas outlet.

The present invention further relates to a process for the partial combustion of a finely divided solid fuel with a free-oxygen containing gas, which process is characterized in that it comprises one or more burners according to the invention. The use of such (a) burner(s) enables processing of solid fuel with a relatively high conversion rate, which makes the process economically attractive over conversion processes in which conventional burners are applied.

Figure 1:
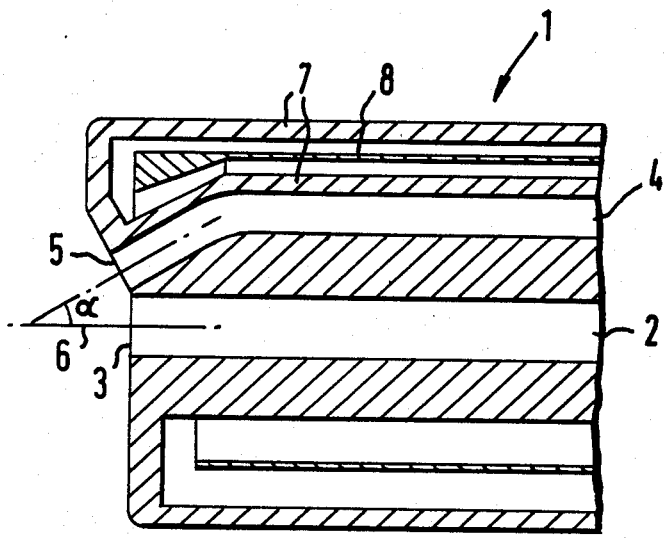
FIG. 1 shows a longitudinal section of the front part of a burner according to the invention.
Figure 2:
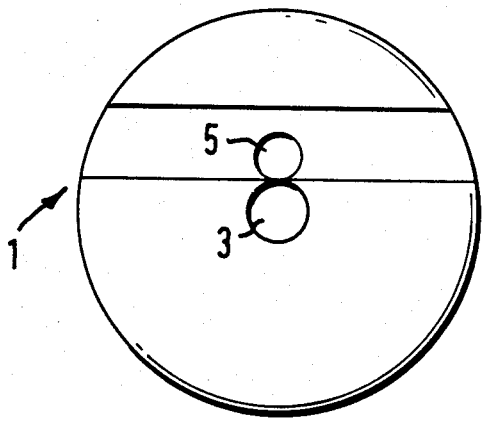
FIG. 2 shows front view II—II of the burner shown in FIG. 1.

FIG. 1 shows the front part of a first burner according to the invention, which burner is indicated with reference numeral 1. The burner 1 is provided with a central channel 2 having a central outlet 3 for free-oxygen containing gas, and a laterally disposed channel 4 with outlet 5 for conveying finely divided solid fuel. The end part of said channel 4 is arranged at a forward angle $\alpha$ to the axis 6 of the central oxygen channel 2. The angle $\alpha$ should be so chosen tht during normal operation solid fuel penetrates between 0.5 and 1.0 of the distance across the jet of free-oxygen containing gas. The central channel 2 and laterally disposed channel 4 are enclosed by a hollow wall member 7, which member is provided with a separating wall 8 for circulating a cooling fluid therethrough. To guarantee a sufficient cooling of the outlet 5 during operation, the part of the hollow wall member 7 in which the channel 4 is arranged is locally extended beyond the remaining part of said wall member. In the embodiment shown in FIGS. 1 and 2 the central channel 2 and laterally disposed channel 4 both have substantially circular cross sections, as depicted in FIG. 2. In order to avoid local recirculation between the exit planes of the fuel outlet 5 and the oxygen outlet 3, these outlets are arranged with respect to one another such that their rims substantially touch one another. The cross-sectional areas of the fuel outlet 5 and the oxygen outlet 3 should be so chosen that during operation the issuing fuel can be fully surrounded by oxygen. Suitably cross sectional areas of the fuel outlet are between 0.4 and 0.1 times the cross sectional area of the oxygen outlet.

During operation of the burner shown in FIG. 1 for producing synthesis gas by partial combustion of coal, pulverized coal is conveyed by a gas or similar fluid through the laterally disposed channel 4. The velocity of the coal should be so chosen as to prevent erosion of the coal channel and outlet. Suitable coal velocities are chosen in the range of about 5 through about 35 m/sec. The coal is partially combusted in a reaction zone downstream of the burner 1 with the aid of oxygen supplied via the central channel 2. The cross sectional area of said channel 2 is so chosen, that at a given throughput of coal and therefore required throughput of oxygen, the oxygen velocity in the central channel is in the range of between 30 and 90 m/sec., and suitably 70 m/sec. The maximum allowable oxygen velocity is determined by the material properties of the burner itself. With the materials normally applied the oxygen velocity should not be chosen above 90 m/sec. to obviate the risk of friction—induced overheating and ignition of the burner—material. The issuing coal jet should be surrounded by oxygen from the central outlet to prevent escape of unconverted coal from the formed coal/oxygen bundle. The coal channel area is thereto chosen to be between 0.4 and 0.1 times the oxygen outlet area. Care should further be taken that the coal jet sufficiently penetrates into the oxygen jet, without however, passing therethrough. To this end the angle $\alpha$ between the outlet part of the coal channel and the oxygen channel is chosen such that the coal jet penetrates between 0.5 and 1.0 of the distance across the oxygen jet before being entrained in that oxygen jet. To achieve this for reasonable coal velocities, the angle $\alpha$ is suitably chosen between about 35 and about 85 degrees. The coal is then dispersed through approximately $\frac{3}{4}$ depth of the oxygen jet with an axial distance of about 2 to 5 times the diameter of the coal outlet, promoting rapid combustion and gasification of the coal. In this manner it is ensured that the temperature in the locality of the burner front are moderate, since substantially all the oxygen is rapidly mixed with coal and substantially no oxygen is available for reacting with reactor gases which might easily cause zones of overheating. Due to the inclination of the outlet part of the coal channel the issuing coal has a velocity component perpendicular to the flow of oxygen, which velocity component gives a momentum which together with the momentum of the oxygen flow causes breaking up of the coal flow. In axisymmetric burners wherein the coal is uniformly distributed around a central oxygen channel the oxygen flow issuing from the oxygen channel is constricted by the issuing coal ring causing a significant local pressure increase which in its turn gives rise to a deflection of the coal velocity profile in a direction parallel to the oxygen flow. This phenomenon means that the coal substantially loses its cross-stream momentum for breaking up the coal flow.

Since the burner construction is such that no gap is present between the issuing coal and oxygen flows local recirculation of oxygen and coal which could lead to flame formation at the burner front and therefore overheating of the burner front, is prevented.

Figure 3:
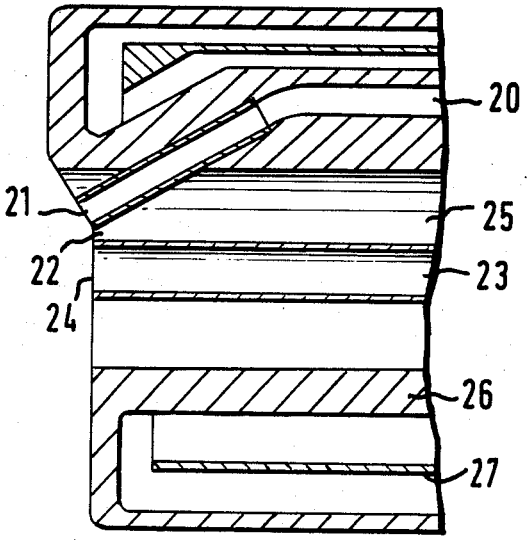
FIG. 3 shows a longitudinal section of the front part of a second burner according to the invention.
Figure 4:
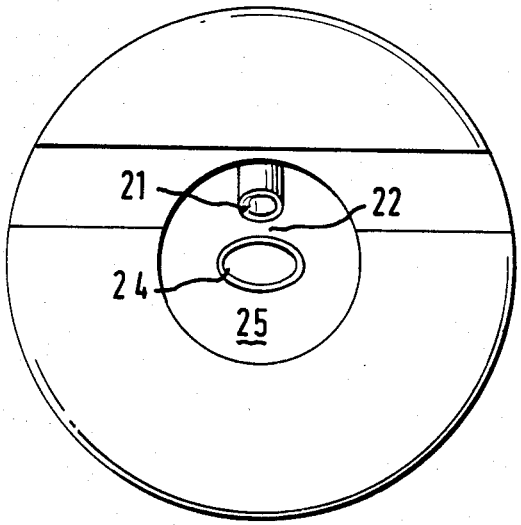
FIG. 4 shows front view IV—IV of the burner shown in FIG. 3.

Reference is now made to FIGS. 3 and 4, showing a second embodiment of a burner according to the invention. In this second embodiment of the invention, the solid fuel conveying means is formed by a channel 20 and an outlet 21 having substantially elliptical cross sections. The outlet 21 is so arranged as to form a gap 22 between said outlet 21 and a central channel 23 with outlet 24 for free-oxygen containing gas. As shown in FIG. 4 the latter channel and outlet are also elliptical in cross section. The central oxygen channel 23 and the downstream end of the fuel channel 20 is surrounded by an annular channel 25 for conveying a moderator gas towards a reactor zone located downstream of the burner. The whole arrangement of oxygen, fuel and moderator gas channels is surrounded by a hollow wall member 26 interiorly provided with a separating wall 27 for circulating cooling fluid thereof. The criteria for inclination of the outlet part of the fuel channel and the cross sectional areas of the fuel outlet and the oxygen outlet are the same as discussed hereinbefore with reference to the first described burner.

During operation of this burner for the gasification of the pulverized coal, a moderator gas, for example steam or carbon dioxide conveyed through the annular channel 25 forms a shield around the issuing coal and oxygen jets. The shield of moderator gas further suppresses the escape of unconverted coal from the formed coal/oxygen jet and is advantageous for preventing premature contact of oxygen with reactor gas, which might easily result in overheating of the burner front and complete combustion of the product gas. By choosing the velocity of the moderator gas issuing from the burner rather low, in the order of magnitude of about 5–10 m/sec., the film of moderator gas surrounding the oxygen and the coal jets prevents excessive circulation of hot reactor gases along the burner front, which circulation might cause overheating of the burner front. Apart from forming a protecting shield around the coal and oxygen jets the moderator gas has a further function in that it fills the gap between the oxygen outlet and the coal outlet thereby preventing recirculation of coal and oxygen in the space between the oxygen jet and the coal jet. As discussed in the above such a recirculation would result in flame generation at the burner front and overheating thereof. The gap between the coal outlet and the oxygen outlet should be kept rather small in order to prevent that at the moment the coal and oxygen jets impinge upon each other, they have lost too much energy for obtaining an effective breaking up of the coal flow. The gap 22 should therefore not be chosen larger than about 0.5 times the width of the coal outlet 21 measured in a direction perpendicular to the gap 22.

In a variant of the above burner operation, the moderator gas may be replaced by part of the oxygen feed stream, keeping the mean exit velocity of this part of the oxygen feed between about 5 and 10 m/sec.

Figure 5:
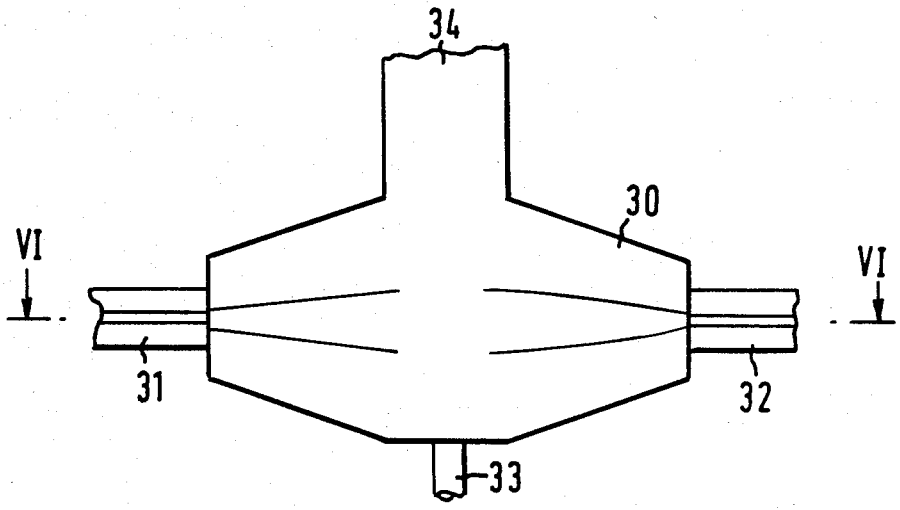
FIG. 5 shows a longitudinal section of symmetrically arranged reaction provided with burners according to the invention.

In FIG. 5 a reactor 30 for gasification of a finely divided solid fuel is schematically depicted. The reactor 30 is provided with two burners 31, 32 arranged opposite to one another in a lower part of the reactor wall. The reactor 30 itself has a conventional shape in that it is substantially symmetrical, having a centrally arranged slagtap 33 in the bottom of the reactor and a centrally arranged gas outlet 34 in the top part thereof. If the shown symmetrical reactor is provided with conventional axisymmetric burners, arranged opposite to one another, the jets of oxygen and solid fuel issuing from the burners during operation impinge upon one another in the center part of the reactor. The velocity of the unconverted solids in the oxygen/solids jets will be considerably reduced by the impingement of the jets, which may result in breakthrough of the solids from the jets. In this case part of the solids will pass downwards towards the slagtap without being converted. The efficiency of the reactor will be lowered by the above phenomenon occurring with axisymmetric burners. Apart from a decrease in efficiency the above conventional arrangement of a reactor with axisymmetric burners may result in a pollution of the product gas by solids leaving the reactor over the top. The impingement of the solids/oxygen jets occurring with axisymmetric burners will cause a heavily turbulent motion of the reactants in the reactor space. Due to this motion lighter solids may be easily entrained by the flow of product gas leaving the reactor. To overcome the above problems, the reactor might, for example, be provided with laterally disposed outlets for gas and slag or with burners not arranged opposite to one another. Each of these solutions would result in an asymmetric reactor, which in unattractive from the viewpoint of strength requirements and potential vibration problems. The asymmetric burners as now proposed enables the risk of breakthrough of solids resulting in efficiency decrease and product gas pollution to be minimized without, however, affecting the preferred symmetrical arrangement of gasification reactors.

Figure 6:
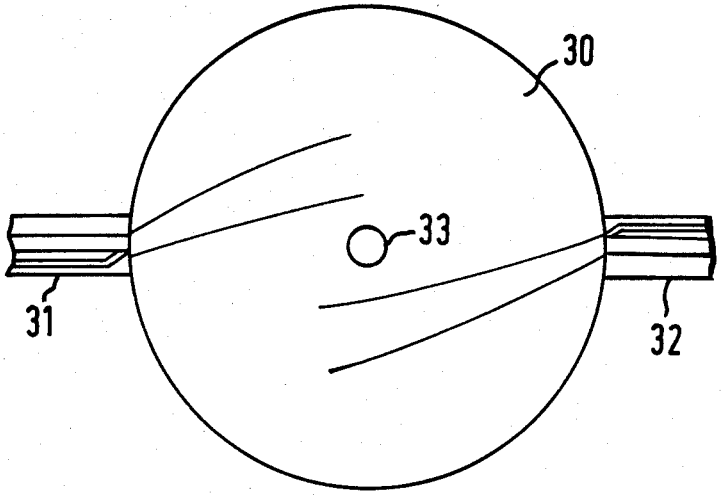
FIG. 6 shows cross section VI—VI of the reactor shown in FIG. 5.

In the embodiment shown in FIG. 5, two asymmetric burners according to the invention are arranged opposite to one another. These burners 31 and 32, only schematically indicated in this Figure, may be of one of the types shown in the previous Figures. The burners are so disposed in the reactor wall that during operation the solid fuel/oxygen jets issuing from the burners deflect in different directions so that the jets substantially miss each other. As shown in FIG. 6, the solid/oxygen jet from the burner 31 at the left hand side of the reactor and that from the burner 32 at the right side of the reactor deflect to the left with respect to the burner axes. To obtain these jet patterns the solid fuel outlets of burner 31 and burner 32 are both disposed at the right hand side of the accompanying oxygen outlet.

It should be noted that the present invention is not restricted to an asymmetric burner having a single outlet for solid fuel. Instead of a single solid fuel outlet, a plurality of outlets for solid fuel may be applied, provided that they are not uniformly distributed around the central oxygen channel. The solid fuel outlets should be so arranged with respect to the central oxygen channel, that during operation the main flow from the central channel is deflected in a lateral direction.

The front of the proposed asymmetric burner may be flat, as shown in the Figures, or may be convex or concave relative to the solid fuel and oxygen outlets.

Finally, it should be noted that the burner shown in FIGS. 1 and 2 may be further provided with conduit means surrounding at least the central oxygen outlet and the solid fuel outlet for conveying low velocity gas around the jets from the said outlets.

What is claimed is:

1. Burner for the partial combustion of a finely divided solid fuel, comprising:

a central channel with a central outlet for free-oxygen containing gas;

laterally disposed conduit means for finely divided solid fuel;

said conduit means having outlet means whose major axis is positioned to intersect the axis of the central outlet, said outlet means being asymmetrically arranged with respect to said central outlet; and said conduit means having a diameter and disposition such that the finely divided solid fuel issuing from it penetrates into and is surrounded by a stream of free-oxygen containing gas issuing from said central channel without passing through that stream.

2. Burner as claimed in claim 1, wherein the outlet means of the laterally disposed conduit means and the central outlet have rims substantially touching one another.

3. Burner as claimed in claim 1, wherein the outlet means of the laterally disposed conduit means and the central outlet are slightly spaced apart from one another to form a gap, said burner further comprising means for conveying low velocity gas through said gap.

4. Burner as claimed in claim 3, wherein the outlet means of the laterally disposed conduit means and the central outlet are spaced apart at a distance of about at most, half of the width of the outlet means for finely divided solid fuel.

5. Burner as claimed in claim 4, wherein the axis of the outlet means of the laterally disposed conduit means is arranged at a forward angle of at least about 35 degrees to the axis of the central outlet.

6. Burner as claimed in claim 5, wherein the axis of the outlet means of the laterally disposed conduit is arranged at a forward angle of at most about 85 degrees to the axis of the central outlet.

7. Burner as claimed in claim 6, further comprising means for conveying a moderator gas around the central outlet and laterally disposed outlet means.

8. Burner as claimed in claim 7, wherein the laterally disposed outlet means is formed by a single outlet channel.

9. Burner as claimed in claim 7, wherein the laterally disposed outlet means is formed by a plurality of spaced apart outlet channels, distributed along a part of the circumference of the central channel.

10. Burner as claimed in claim 9, wherein the outlet means for finely divided solid fuel and/or the central outlet are substantially circular in cross section.

11. Burner as claimed in claim 9, wherein the outlet channel for finely divided solid fuel and/or the central outlet are substantially elliptical in cross section.

12. Burner as claimed in claim 11, wherein the (total) area of the outlet end(s) of the outlet channel(s) is between about 0.4 and 0.1 times the area of the central outlet.

* * * * *